United States Patent [19]

Loszewski et al.

[11] 4,305,449

[45] Dec. 15, 1981

[54] METHOD OF AND APPARATUS FOR FABRICATING FILAMENT REINFORCED METAL MATRIX STRUCTURES

[75] Inventors: Raymond C. Loszewski, Windham, N.H.; Edward S. Salter, Ashby, Mass.

[73] Assignee: Avco Corporation, Wilmington, Mass.

[21] Appl. No.: 161,349

[22] Filed: Jun. 20, 1980

[51] Int. Cl.[3] ..... B22D 19/16

[52] U.S. Cl. ..... 164/80; 164/97; 75/226; 75/DIG. 1

[58] Field of Search ..... 164/80, 97, 120; 75/226, DIG. 1; 264/314

[56] References Cited

U.S. PATENT DOCUMENTS

| | | | |
|---|---|---|---|
| 3,377,657 | 4/1968 | Richardson et al. | 425/405 |
| 3,668,748 | 6/1972 | Divech et al. | 164/120 X |
| 3,962,394 | 6/1976 | Hall | 264/314 X |
| 4,065,302 | 12/1977 | Turillon | 75/226 X |

FOREIGN PATENT DOCUMENTS

| | | | |
|---|---|---|---|
| 2349776 | 5/1974 | Fed. Rep. of Germany | 75/226 |
| 441325 | 8/1975 | U.S.S.R. | 75/226 |

*Primary Examiner*—Robert D. Baldwin
*Assistant Examiner*—K. Y. Lin
*Attorney, Agent, or Firm*—Abraham Ogman

[57] ABSTRACT

Lightweight filament reinforced composite metal matrix structures is provided. The preferred process for producing tubing comprises wrapping alternate layers of metal and filament material to be molded around a mandrel. The mandrel is removed and in its place a test tube-shaped hollow glass cylinder is inserted. The wrapped cylinder is next placed in a cylindrical shaped mold and the entire assembly placed in an oven which is capable of heating the unit to the liquidus temperature of the metal matrix. The glass, which is of a type which softens at about the melting point of the matrix material, is pressurized to a medium high pressure. Under the influence of this pressure, the glass expands, forcing the composite metal matrix against the interior surface of the mold. The consolidated tubing is then cooled to a completely solidified state and removed from the mold.

6 Claims, 5 Drawing Figures

METHOD OF AND APPARATUS FOR FABRICATING FILAMENT REINFORCED METAL MATRIX STRUCTURES

DESCRIPTION

BACKGROUND OF PRIOR ART

This invention relates to filament reinforced metal matrix structure and the method of and apparatus for making such structure. The invention contemplates the manufacture of such structure by placing alternate layers of metal and fiber reinforcements on top of each other around a hollow form, placing this assembly into a female mold, then consolidating the layers into a metal matrix by the application of internally applied pressure to the form while the assembly is maintained at a high temperature. Gases may be evacuated to minimize oxidation of the matrix material. The consolidation takes place by plastic flow densification, melting and/or diffusion bonding.

Other methods of making filament reinforced materials are known. Cochran et al in U.S. Pat. No. 3,547,180 teaches one method of producing reinforced composites. In the method of Cochran et al fibrous material, such as sapphire whiskers, is infiltrated with molten aluminum. This is done by placing a fibrous skeleton in an aluminum mold. The mold and its contents, together with an aluminum billet, are heated to at least 500 C., after which it is evacuated of gases. The temperature is then increased above the melting point of the aluminum billet. Pressure is next applied to force molten aluminum to infiltrate the fibrous skeleton within the mold. After cooling, the composite is removed from the mold and subjected to any further processing, such as machining.

Divecha et al in U.S. Pat. No. 3,668,748 discloses means for producing a fiber reinforced metal composite of desired shape. The metal matrix and fibers are integrated under pressure with the mixture maintained at a temperature wherein the matrix system is partly in the liquid and partly in the solid phase, enabling consolidation through extrusion in a die cavity.

Richardson et al in U.S. Pat. No. 3,377,657 discloses a method of molding reinforced plastic pipe. The pipe is nonmetallic being typically comprised of a corrosion resistant plastic lining encased within resin impregnated fibrous tapes having longitudinal reinforcing strands. A mandrel is used for laying up the tape.

Sara in U.S. Pat. No. 3,571,901 describes means for improving the wettability of carbon fibers which are to be imbedded in an aluminum composite article. Sara achieves improved wetting of the carbon fibers by first coating them with silver or silver-aluminum based alloys.

Pratt in U.S. Pat. No. 3,290,728 describes means for forming reinforced plastic pipe. Typically, the reinforcing material can be paper, asbestos, glass webs, glass filaments, or glass fabrics. One of the features of the invention is the utilization of a mandrel having an expansible sleeve or diaphragm on its exterior surface which can be internally pressurized to force the pipe material against an encircling mold during heat curing of the resin.

For purposes of this discussion, the term "filament" shall mean monofilaments, rovings comprising monofilaments, staple fibers, and thread or yarn made from staple fibers, short whiskers, etc. The physical form of such reinforcements is not critical to the practices of this invention.

There are materials, notably certain glasses, fused silica, and quartz which, when softened, retain sufficient strength to expand like an elastomeric material. Our invention makes use of these materials operating in the temperature range normally used for consolidating metal matrices to form metal matrix composites. In general, the consolidation temperatures are maintained so that the matrix system is partly in the liquid and partly in the solid phase.

It will be shown that over a specifiable temperature range, the walls of a softened glass container can be expanded under the influence of pressure to make metal matrix material positioned over the glass container to conform to the shape of a cavity. This is an improvement over prior art methods which, in general, utilize extrusion dies and expandable metal mandrels.

BRIEF SUMMARY OF THE INVENTION

This invention relates to a method of and apparatus for making filament reinforced metal matrix tubing and other structural shapes. For example, the structure can be metals such as aluminum or titanium composite having reinforcing filaments molded therein. The process for producing the structure comprises the wrapping of metal foil interspersed with layers of monofilament fibers and/or combinations on a mandrel. Wrapping is continued until a specified thickness is achieved. For ply uniformity or maintaining fiber orientation, the composition of the metal itself or of alternate layers may be varied so that on heating, the metal does not all reach the liquid state at the same temperature. The filaments are usually arranged so that they lay lengthwise down the tubing. An alternate arrangement can include a circumferential winding of filaments or combination of both. For cosmetic or release purposes, a layer of some other metal foil may be included on the inside or outside of the structure. The layers of foil and filaments form a "preform."

The "preform" is then removed from the mandrel and a test tube-shaped hollow glass cylindrical bladder inserted in its stead. The "preform" and glass bladder are next placed in a split die mold which is clamped in a press or a solid mold is placed in a furnace capable of raising the assembly to the liquidus temperature of the metal matrix.

Fittings are provided in the mold for pressurizing the interiors of the glass cylinder which, on softening, functions as a glass bladder. Under influence of the pressure against the glass, the composite metal matrix is forced outward against the mold. The "mushy" mixture of liquid and solid phases of the metal is consolidated, the filaments are wetted into the structure, and the tubing is made to conform to the shape of the mold. On cooling, the tube is removed from the mold and the glass bladder withdrawn. The mold is also fitted with fittings for drawing a vacuum and/or back-filling with inert gases for use with metals that are prone to oxidation (e.g. aluminum).

With our invention, lightweight composite metal matrix structures are produced which conform to stringent outside and inside diameter specifications. Tube lengths in excess of 36 in. have been fabricated using this method.

DETAILED DESCRIPTION OF INVENTION

Filament reinforced metal composites can be compacted and consolidated by hot pressing while in the liquid phase of the matrix. Hot pressing requires a distinct two-phase-type metal matrix. Use of a metal alloy will achieve this in that there can be both liquid and solids within the alloy at certain temperatures.

Figure 2:
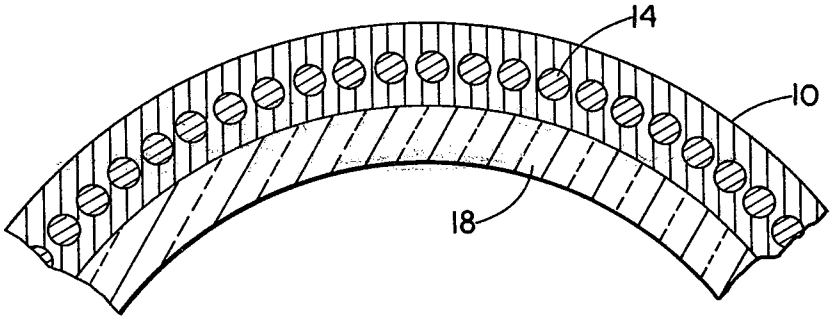
FIG. 2 is a cross-sectional view of the tubular member taken along line 2—2 of FIG. 1 showing the fiber reinforced structure and the glass bladder used to consolidate the metal matrix.
Figure 3:
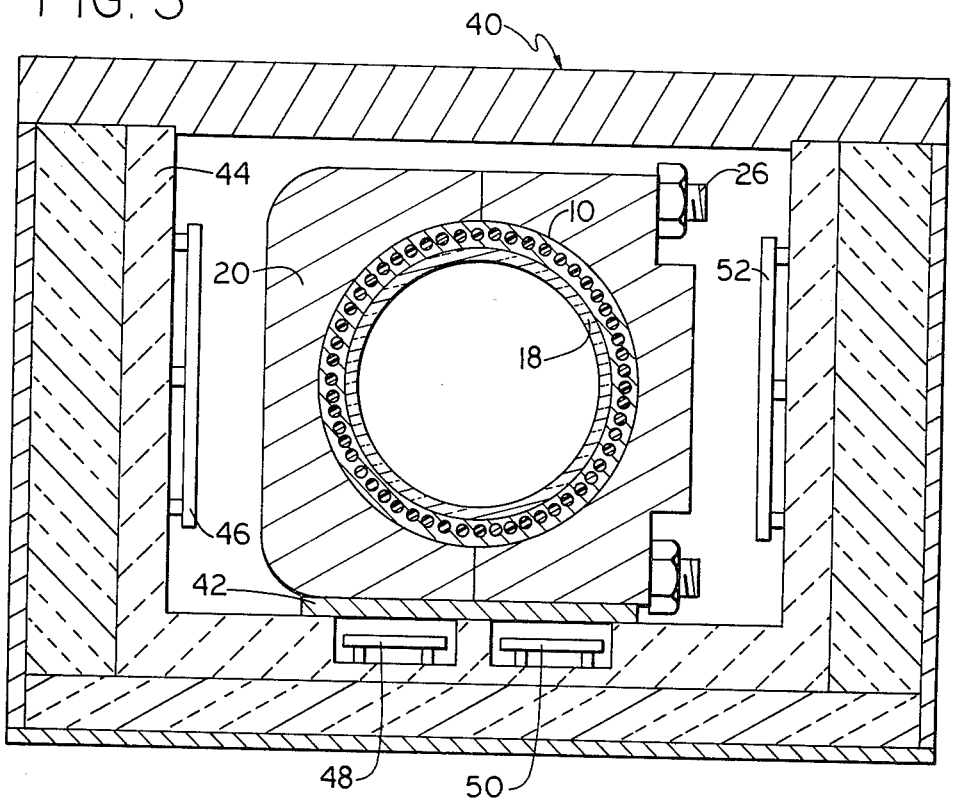
FIG. 3 shows a cross-sectional view of the mold assembly placed in an electric furnace with the view being along line 3—3 of FIG. 1.
Figure 4:
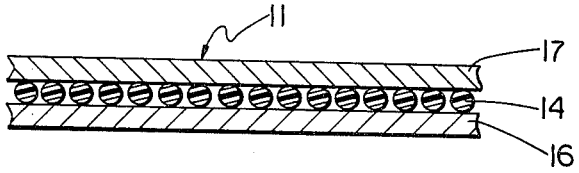
FIG. 4 is a cross section of the preferred basic "monolayer" structural element.

In the tubing making process reduced to practice, the filament reinforced metal matrix was formed as shown in FIGS. 1–5 using monolayers 11. A section of a typical monolayer is shown in FIG. 4. In the unit reduced to practice, the monolayers 11 include type 6061 aluminum foil 16 and type 4343 brazing foil 17. Sandwiched between the aluminum foil 16 and the brazing foil 17 is a layer of reinforcing filaments 14.

Figure 1:
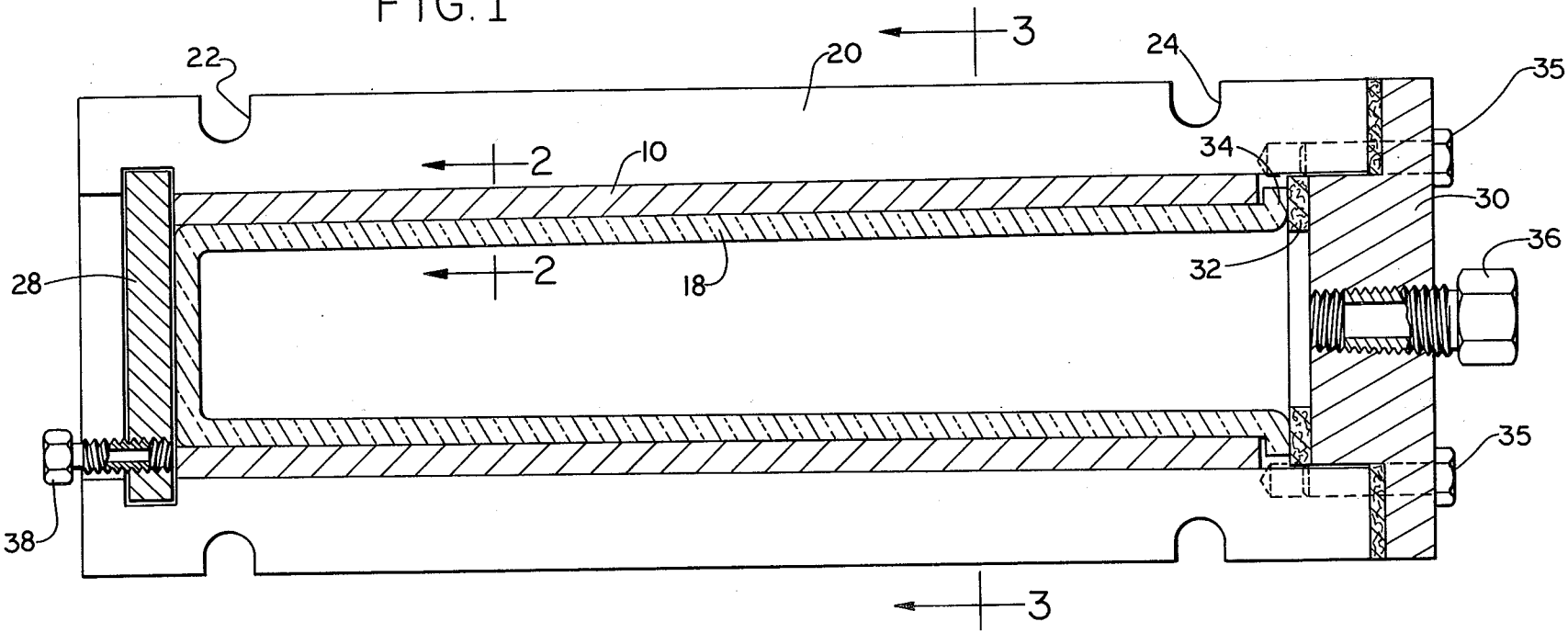
FIG. 1 is a cross-sectional view, in elevation, showing the arrangement of metal matrix tubing within a split mold.
Figure 5:
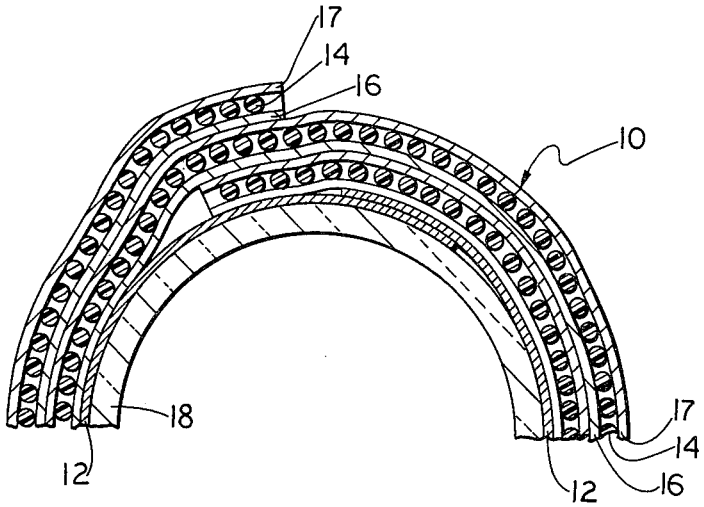
FIG. 5 is a cross-sectional view of the tubular member of FIG. 1 showing a multi-layered structure and the bladder used to consolidate the metal matrix. Two plies are shown for simplicity, but as many as 7 plies have been fabricated successfully.

A tubular section 10 of the matrix material having a shape generally as seen in FIG. 1 is formed by wrapping layers of monolayers 11 on a mandrel (not shown). Initially, a single wrap of 0.005 in. thick of stainless steel foil 12 (see FIG. 5) is laid down on the mandrel. The purpose of the stainless steel foil 12 is to facilitate removing the glass bladder from the formed tube in the manner explained hereinafter. Next, a plurality of layers of the FIG. 4 monolayers 11 are wound on the mandrel over the stainless steel foil 12 as shown in FIG. 5. The reinforcing filaments 14 are oriented side by side so that they extend the length of the tube section. During the process of consolidating the tubular section, the brazing foil 17 will melt, flowing around the reinforcing elements, and in the process, binds all adjoining foils 16 together.

After laying up the desired monolayers 11, the tubular shaped assembly is then removed from the mandrel and a glass bladder 18 (see FIGS. 1 and 4) inserted within the tube. In the unit reduced to practice, bladder 18 resembled a large test tube in shape. The tube assembly 10 together with the glass bladder 18 was then placed in a mold 20. Mole 20 was a two-piece unit having an end view as shown in FIG. 3. Grooves 22 and 24 near the ends of the mold (see FIG. 1) provided means for clamping the two halves of the mold together using U-bolts 26. An end cap 28 inserted in a groove within mold 20 provided a closure for the left-hand end of the mold in the position shown in FIG. 1. The second end of the mold was fitted with a compressive type closure 30. A gasket 32 provided a seal between compressive closure 30 and the outward extending lip 34 of glass bladder 18. In the unit reduced to practice, the compressive fit was obtained by the use of bolts 35.

In the center of compressive closure 30 was a fitting 36 which allowed the interior of the glass bladder 18 to be pressurized by means of an air line not shown. At the left-hand end of the mold shown in FIG. 1 was a second fitting 38 to which a vacuum line (not shown) was attached. The entire mold assembly was then placed in an electric furnace 40 such as that shown in FIG. 3.

As depicted in FIG. 3, the mold assembly 20 rests on a hearth plate 42. The furnace would typically have a semirefractory lining 44 around the heated chamber. Attached to the sides and the bottom of the chamber is a series of resistive heat elements 46, 48, 50 and 52. Control elements on the outside of the furnace allow the temperature within the heat chamber to be closely controlled.

In the unit reduced to practice, a lead bearing glass bladder 18 was used. The furnace temperature was raised to a value between 540 C. and 600 C. Fitting 36 was then pressurized to a value of approximately 400 psi. As the temperature within the mold was gradually raised to a value above 500 C., the glass bladder began to soften. As it softened, it began to function as an elastomeric material while still retaining sufficient strength to act as a compressive force against the interior of the filament reinforced tubing. As the liquidus state of the aluminum alloy was reached, the metal began to consolidate around the boron-carbide reinforcing filaments. Eventually, the consolidated state shown in FIG. 2 was reached.

During the consolidation phase, the vacuum pressure maintained via fitting 38 serves to extract any air bubbles and volatile gases from the interior of the tubing. Evacuation minimizes oxidation of the metal. Use of the alloying element, type 4343 brazing foil, creates a consolidated tubing which is free of all voids. Further, the boron-carbide filaments are fully wetted during the consolidation process. After cooling within the furnace the resulting tubular elements have an outside dimension with excellent tolerances.

Removal of the glass bladder from the bonded tube proved to be a difficult problem. Spraying the bladder with Dag mold release did not help. Thermal shocking of the tube as well as use of other commercially available release agents did not overcome the problem. It was then discovered that wrapping of the glass bladder with a stainless steel foil would allow removal of the glass bladder from the bonded tube. Another means for removing the glass bladder was achieved by placing a stainless steel rod between the bladder and the wrap prior to inserting the assembly into the mold. This allowed the glass to form around the stainless steel rod when the temperature reached 600 C. and the pressure of fitting 36 was raised to 500 psi. During cool-down, the thin layer of glass around the rod will break leaving a channel the length of the tube. This channel allows the remaining glass to be removed from the tube with ease. In order to prevent the rod from being pushed into the metal matrix tubing at high pressure, a stainless steel shim was placed between the glass bladder and the interior of the tubing.

Using the techniques described above, straight tubes up to 1 meter in length were formed using both a one-piece and a split-die mold. Use of the one-piece mold proved to be highly advantageous in that critical outside dimensional tolerances could be maintained. Additionally, there were no seams on the final tube. Ply uniformity and tube thickness control were excellent when using the one-piece mold.

It is to be understood that the FIG. 2 configuration is only representative of the tubing cross section. With the method described above, multiple ply metal matrix tubes have been fabricated. This has been accomplished (see FIG. 5) by wrapping alternate layers of metal 16 and 17 and filaments 14 on the mandrel during the lay-up phase. When making filament reinforced titanium tubing, a quartz glass bladder would be utilized. Titanium has a melting point of 1675 C. and fused quartz has a softening temperature of 1667 C. For aluminum alloys, a soda borosilicate glass having a softening temperature of 693 C. would be apropos.

Filaments suitable for use as reinforcements are boron, carbon, silicon carbide and the like, as these are compatible with aluminum and titanium matrix materials. To prevent or minimize chemical reactions from taking place between the filaments and the matrix materials, the filaments are frequently coated.

Inorganic products of fusion capable of being used as bladder materials include those ceramics which have the property of strongly resisting compressive forces. Ceramics which have this property include glasses such as borosilicate glass, solder glass, silica boron oxide glass, etc., fused silica, and fused quartz previously identified. All of these have in common a viscosity versus temperature function which is continuous; that is, such material has uniform flow characteristics without cracking and while resisting compressive forces. Most metals have a discontinuous function and generally lose their compressive strength at temperatures used to form a metal matrix.

Relative to metals, the glasses are uniquely suited for use as bladders. Metals genrally will not yield at the temperatures used to form the tubular members. Even under the influence of extremely high pressures, it is doubtful that metal bladders can be made to yield sufficiently to form tubular members in a solid state.

Aluminum bladders don't work either. They are costly to form, do not seal readily, and tear rather than yield uniformly.

While only one form of the invention has been shown, it is to be recognized that other forms and variations will occur to those skilled in the art. For example, hollow shapes other than tubing can be formed in the same manner as described. Therefore, while the preferred form of the invention has been concisely illustrated in order to fully explain the principles of the invention, it is not our intention to limit or narrowly describe the invention beyond the broad concept set forth in the appended claims.

We claim:

1. A method of forming a metal matrix composite tube comprising:

layering up alternate layers of metal foil and reinforcing filament on a hollow ceramic bladder, the matrix material and said bladder material having similar softening temperatures, said bladder material having a continuous viscosity versus temperature curve for yielding uniformly while retaining its compressive strength and further retaining its strength when softened so that it can be expanded when pressure is applied;

placing said layers and bladder in a mold;

heating said mold and contents to the softening temperature of said metal matrix material and bladder material;

applying pressure within said bladder to cause the bladder to expand causing said matrix material and filaments to consolidate into a composite conforming to said mold; and cooling said mold and contents and removing said bladder.

2. A method as described in claim 1 where the ceramics are characterized as having a viscosity that decreases continuously as the temperature is increased.

3. A method as described in claim 2 where the ceramics are taken from the group consisting of borosilicate glass, solder glass, silica boron oxide glass, fused silica and fused quartz.

4. A method as described in claim 1 which includes the step of evacuating said filaments and matrix material to aid in said consolidation.

5. A method as described in claim 1 where said matrix material is aluminum alloy and said bladder material is soda borosilicate.

6. A method as described in claim 1 where said matrix material is titanium and said bladder material is fused quartz.

* * * * *